US009764211B2

(12) United States Patent
Maginnis

(10) Patent No.: US 9,764,211 B2
(45) Date of Patent: Sep. 19, 2017

(54) CONVERTIBLE GOLF CHIPPING GAME

(71) Applicant: Austin Maginnis, Cedar Falls, IA (US)

(72) Inventor: Austin Maginnis, Cedar Falls, IA (US)

( * ) Notice: Subject to any disclaimer, the term of this patent is extended or adjusted under 35 U.S.C. 154(b) by 0 days.

(21) Appl. No.: 15/254,499

(22) Filed: Sep. 1, 2016

(65) Prior Publication Data

US 2017/0095715 A1 Apr. 6, 2017

Related U.S. Application Data

(60) Provisional application No. 62/237,645, filed on Oct. 6, 2015.

(51) Int. Cl.
*A63B 63/00* (2006.01)
*A63B 69/36* (2006.01)

(52) U.S. Cl.
CPC ..... *A63B 63/00* (2013.01); *A63B 69/3661* (2013.01); *A63B 2210/50* (2013.01)

(58) Field of Classification Search
CPC ..... A63B 63/00
See application file for complete search history.

(56) References Cited

U.S. PATENT DOCUMENTS 5,242,169 A 9/1993 Laabs et al.
5,383,665 A * 1/1995 Schultz ..... A63B 63/00 473/159
5,407,203 A 4/1995 Jones
5,575,480 A * 11/1996 Wehr ..... A63B 67/06 273/402
8,864,596 B1 * 10/2014 Maranian, Jr. ..... A63B 69/3661 473/162
2005/0209014 A1 * 9/2005 Kim ..... A63B 24/0021 473/157
2011/0256945 A1 * 10/2011 Hsiang ..... A63B 63/00 473/194
2016/0008689 A1 * 1/2016 Janeri ..... A63B 67/06 273/402

* cited by examiner

*Primary Examiner* — Michael Dennis
(74) *Attorney, Agent, or Firm* — Nyemaster Goode, P.C.

(57) ABSTRACT

The present disclosure is a portable playing system for a golf chipping game rectangular in shape. The playing system has a first surface with a shooting region and a scoring region, and a second surface parallel to the first and has substantially the same dimensions. The first and second surfaces each have a circular hole with a center located within about 12 inches of one end of the first and second surfaces. The first surface has a goal disposed substantially on one end of the first surface. The goal has at least two vertical side posts, a horizontal crossbar, and a mesh net connected to the side posts and crossbar extending within the entire goal and configured to trap a ball within the goal. The portable playing system has a first playing position with the first surface up, and a second playing position with the second surface up.

19 Claims, 11 Drawing Sheets

CONVERTIBLE GOLF CHIPPING GAME

CROSS-REFERENCE TO RELATED APPLICATION(S)

This application claims priority to U.S. Provisional Patent Application No. 62/237,645, filed on Oct. 6, 2015, entitled "Flop Shot (Backyard Game)," the disclosure of which is hereby incorporated herein by reference in its entirety.

BACKGROUND

Playing games at parties and tailgates is becoming a favorite pastime for many. Portable games like cornhole or bag toss are becoming more popular as they provide platforms to play games that are easy and quick to set up and take down. However, these games generally are configured to allow users to play a single game. If a user would like to change the game she is playing, another set of boards or other implements is required to be set up. In addition, there are few portable multi-player games based on golf. If a user wants to play a game like golf, he or she generally needs to find a miniature golf course or settle for single-player putting games.

SUMMARY

One aspect of the present invention includes a portable playing system for a golf chipping game rectangular in shape. The playing system has a surface with a chipping "rough" region and a scoring "green" region, and a second surface parallel to the first with substantially the same dimensions. The first and second surfaces each have circular holes with centers located within about 12 inches of one end of the first and second surfaces. The first surface has a goal disposed substantially on one end of the first surface. The goal has at least two vertical side posts, a horizontal crossbar, and a mesh net connected to the side posts and crossbar extending within the entire goal and configured to trap a ball within the goal. The portable playing system has a first playing position with the first surface up, and a second playing position with the second surface up.

Another aspect of the present invention includes a manually portable playing board having a first surface rectangular in shape and having a length longer than a width, and having a hole located in the middle of the width, and closer to a first end than a second end. The first surface has a chipping portion and a scoring portion in addition to the hole, each of which is assigned points to score the game. A second surface is parallel with the first surface and substantially the same dimensions as the first surface, wherein the hole in the first surface extends through the board and the second surface. On the first surface, there is a goal assembly configured to span substantially the entire width, comprising at least two substantially vertical side post assemblies which fit into or are anchored in the board and a substantially horizontal crossbar coupled to the top of the side post assemblies, and a mesh net connected to the side posts and crossbar and spanning substantially the entire area between the side post assemblies and from the crossbar to the first surface. The two side post assemblies may each have an upper post and a lower post, and the first surface faces in a substantially upward direction.

In another embodiment of the present invention, a method exists to convert a manually portable playing board from a golf chipping game to a bean bag toss game. The method further includes disassembling each of the two side post assemblies by detaching the upper post from the lower post, removing the two upper posts, the crossbar, and the mesh net from the board, leaving the two lower posts anchored in the board, flipping the board over such that the first surface faces downward, and resting the board on the ground such that the board is supported on the two lower posts and the second end of the board.

These and other aspects, objects, and features of the present invention will be understood and appreciated by those skilled in the art upon studying the following specification, claims, and appended drawings.

DETAILED DESCRIPTION OF EMBODIMENTS

Figure 1:
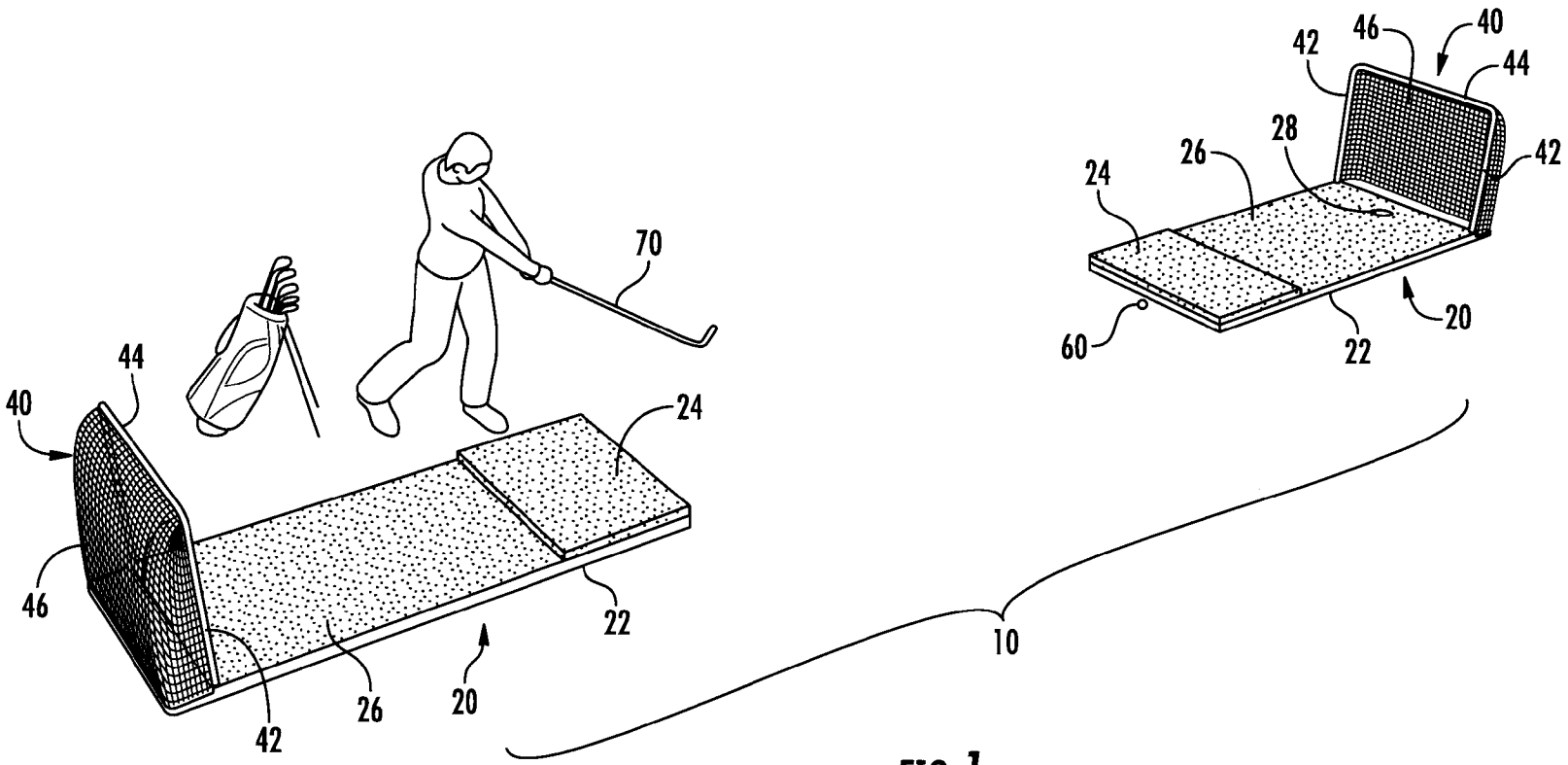
FIG. 1 is an isometric view of a golf chipping game.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, shown is a portable playing system 10 for a golf chipping game. While the playing system 10 as shown in FIG. 1 has two portable playing boards 20, it may also have only one playing board 20. The boards 20 may have a chipping region 24, a scoring region 26, and a hole 28. The hole 28 may be a through-hole, or may not go all the way through for easy access to balls or bags that fall into the hole 28. The boards 20 may be offset from one another by any distance commensurate with the level of skill of the player or players using the system 10. Typically, the boards may be offset by about 20 feet to about 30 feet depending on skill level of the player(s), preferably offset by 27 feet.

Figure 2:
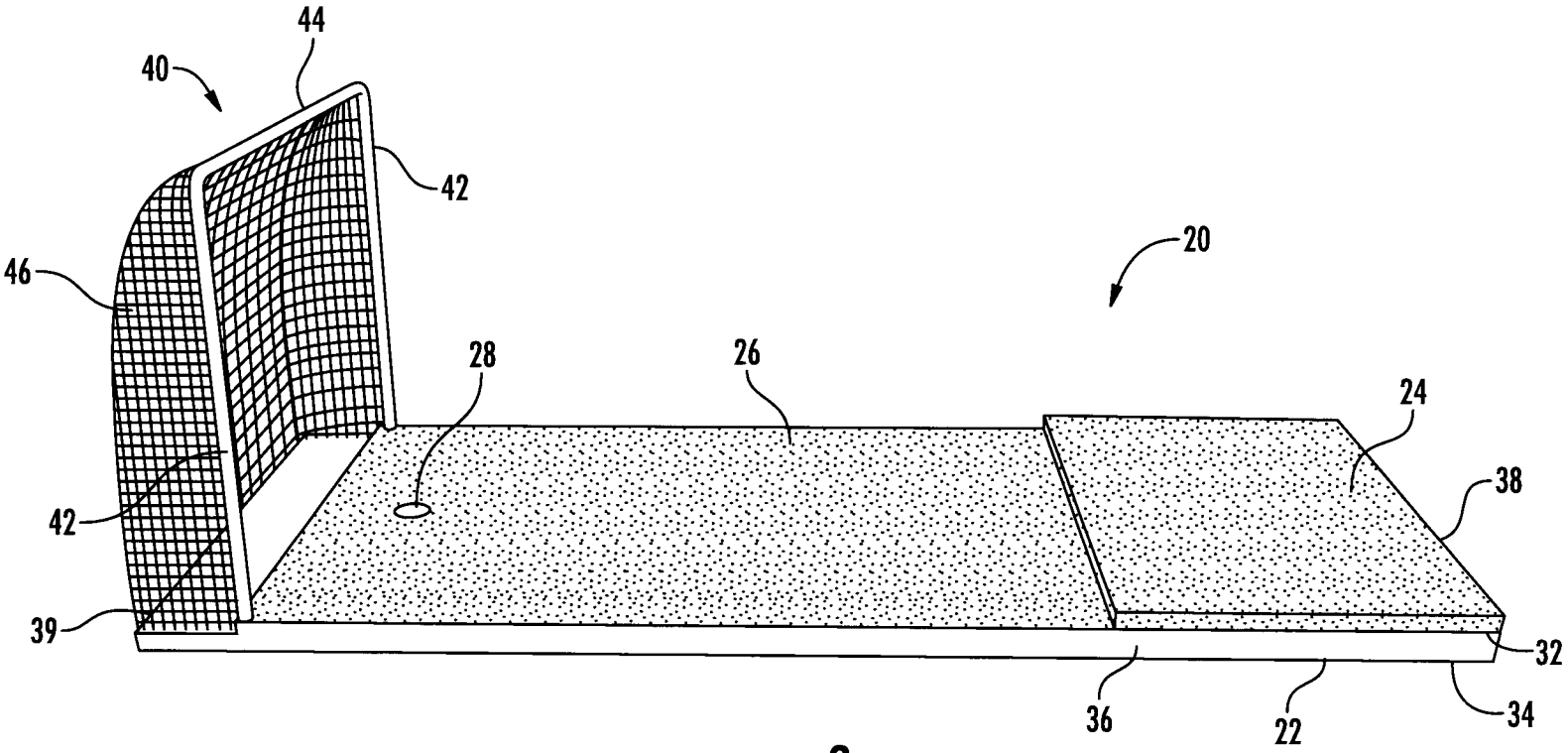
FIG. 2 is a side elevation view of one board of the golf chipping game.
Figure 3:
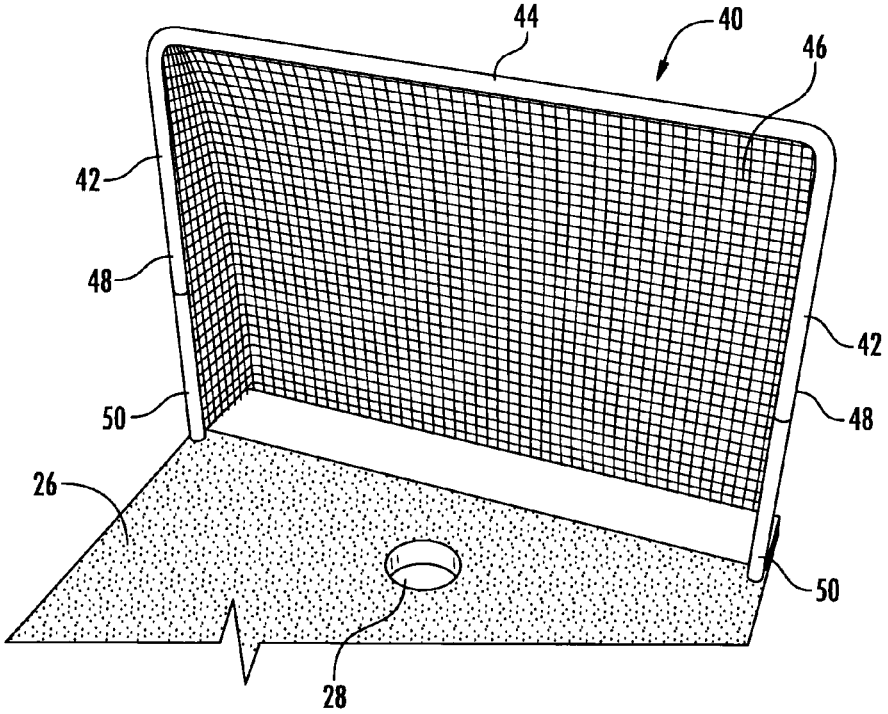
FIG. 3 is a closer isometric view of a goal of the golf chipping game.
Figure 4:
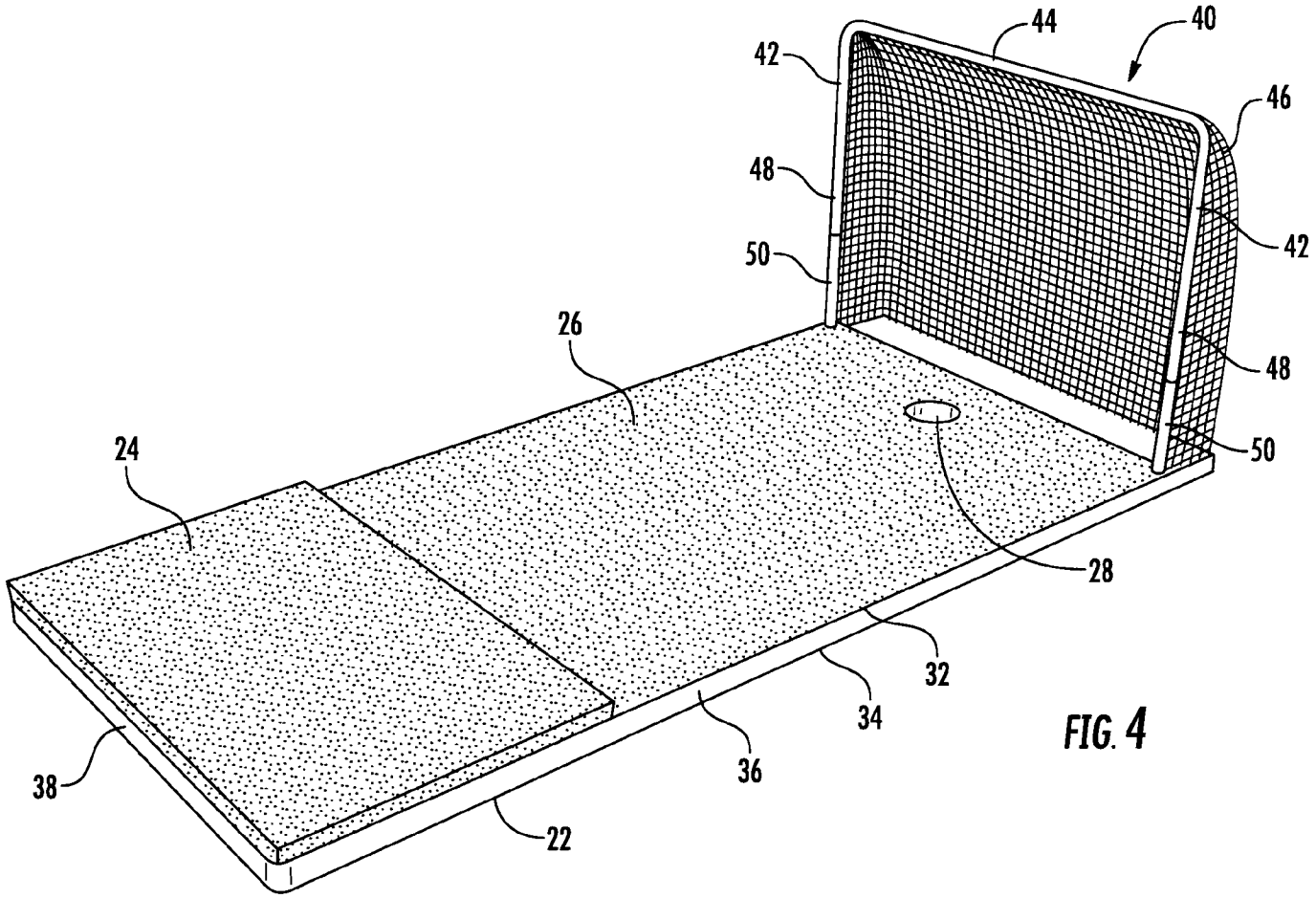
FIG. 4 is an isometric view of one board of the golf chipping game.

FIG. 2 shows the playing board 20 in more detail. The playing board 20 may have a baseboard 22. The baseboard 22 may be a homogenous material, such as a dense injection molded plastic material, a rubber material with wood or glass infused for structural integrity, or a solid wood construction. The baseboard 22 may also be formed in pieces, with a thin flat board surface on top 22*a* and bottom 22*b*, and connected by wood pieces on the sides 36.

The playing board 20 may also have a chipping or "rough" region or area 24. The chipping region may have a synthetic material designed to simulate a grass or turf typically found on a golf course. The grass may be about 1 inch to 2 inches in length, more preferably about 1¼ inches to 1¾ inches, and most preferably about 1½ inches in length. The chipping region 24 as shown spans the width of the playing board 22, and extends from a first end 38 of the playing board 22, to a distance from about 8 inches to about 24 inches from the end 38, preferably about 12 inches from the end 38.

The playing board 20 may further include a scoring "green" region or area 26. The scoring region may have a synthetic material designed to simulate a grass typically found on a golf course, similar to the chipping region 24. The grass in the scoring region 26 may be shorter than the grass in the chipping region, about ¼ inch to about ¾ inches in length, most preferably about ½ inches in length. In another embodiment, grass may be the same length as the chipping region, about 1¼ inches to 1¾ inches, most preferably about 1½ inches in length with a line or color difference to differentiate the regions. The scoring region 26 as shown spans the width of the playing board 22, and extends from the end of the chipping region 24 to a second end 39 of the board 22.

In another embodiment, the chipping region 24 may not span the entire width of the board 22, and may be offset from the first end 38. The chipping region 24 may be located anywhere on the board 22, and may be any shape large enough to hold a ball or another game implement such as a puck or a bag. In this embodiment, the scoring region may include all of the area of the top surface 32 of the board 22 not included in the chipping area. The scoring area 26 may also include the chipping area 24 in still another embodiment.

The playing board 22 may further include a hole 28. The hole 28 may be about 5½ inches to about 6½ inches in diameter, preferably about 6 inches in diameter. In another embodiment, the hole may be about the size of a regulation golf hole, or about 4¼ inches in diameter. The hole 28 may be a through-hole such that a ball 60 or another sporting implement falls through the hole and onto the ground when playing. In another embodiment, the hole 28 does not go all the way through the board 22, such that a ball 60 is easier to remove from the hole 28. The game may have rules which designate points earned corresponding to which portion of the board the ball lands within.

Referring now to FIGS. 3-5B, the side posts 42 may fit directly into the holes xx using any means to attach to play board 20. The side posts 42 may also comprise a lower post 50 and an upper post 48. In one embodiment, the lower post 50 may not detach from the board, but may instead be affixed to the board. The upper post 48 and the lower post 50 may be designed for easily assembling and disassembling the post 42.

The upper post 48 and lower post 50 may be coupled by a sleeve 52 that is fixedly attached at a first end 52*a* to the lower post 50. This attachment may be a welded attachment, an interference fit of the sleeve 52 over the lower post 50, or any other means known in the art to fixedly attach the sleeve 52 to the lower post 50. As shown in FIG. 5A, The upper post 48 may then be slidably inserted into a second end 52*b* of the sleeve 52. Conversely, in another embodiment, the sleeve 52 may be fixedly attached to the upper post 48 using any of the above mentioned methods, and the lower post 50 may be slidably inserted into the sleeve.

Figure 5C:
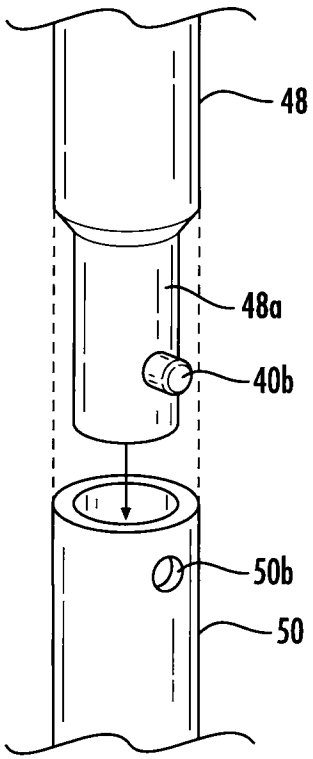
FIG. 5C is still another embodiment of the connection between a lower post and an upper post.
Figure 5B:
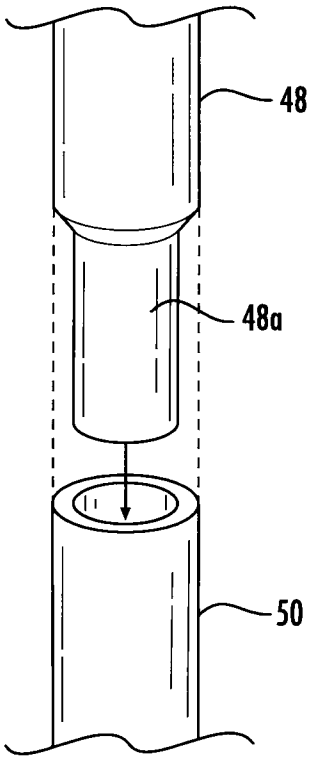
FIG. 5B is another embodiment of the connection between a lower post and an upper post.
Figure 5A:
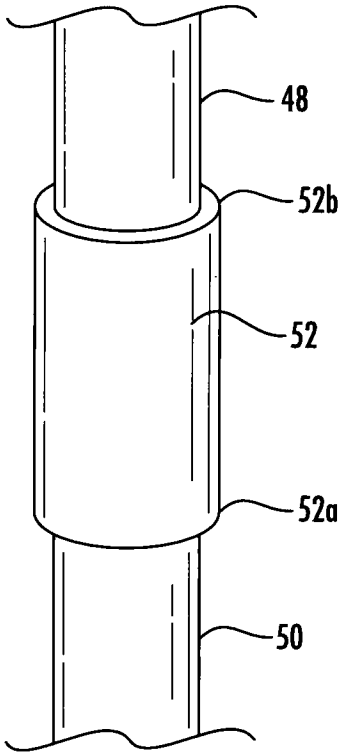
FIG. 5A is one embodiment of the connection between a lower post and an upper post.

As shown in FIG. 5B, in another embodiment, the upper post 48 may have a smaller end portion 48*a*. The smaller end portion 48*a* may be sized for slidable attachment within an inner diameter of the lower post 50. Conversely, the smaller end may be on the lower post 50, and may be slidably attached to the upper post 48. In still yet another embodiment shown in FIG. 5C, the upper and lower posts may be attached via a spring button or spring pin 48*b* on the end portion 48*a* that is locked into a hole 50*b* located on the lower post 50. When a user would like to detach the upper and lower posts, the spring button 48*b* is urged back out of the hole in the lower post 50, allowing the upper post 48 to be slidably removed from the lower post 50.

The surface 34 may be any surface known in the art to allow bean bags or other playing implements to slide on the surface. The surface 34 also may have the hole 128 shown. The hole 128 may be a regulation cornhole sized hole about 5½ inches to about 6½ inches in diameter, preferably about 6 inches in diameter. The hole 128 may have the same axis and be of the same size as the hole 28. In another embodiment, the holes 28 and 128 may share an axis but be of different sizes. In still yet another embodiment, the holes may be different sizes and on different axes.

To play the golf chipping game, a user first places a ball 60 on the chipping or shooting area 24 of the board 20. The user then chips the ball 60 with a club 70, while trying to land the ball 60 on the scoring area 26 of the opposite board 20. The grass-like substance of the chipping area 24 allows a more golf-like feel to a shot, and the grass-like substance of scoring area 26 allows the ball 60 to stop a well placed shot. In another embodiment, a single board 20 may be used, and a user may chip the ball 60 off the ground without the use of the chipping area. Scoring of the game may allow users to gain more points if the ball 60 goes into the hole 28, and fewer points the farther from the hole the ball 60 comes to a rest on the scoring area 26, and still fewer points if the ball 60 comes to rest on the chipping area or in the net, and may give no points to a shot that is not stopped on the board 20.

Figure 6:
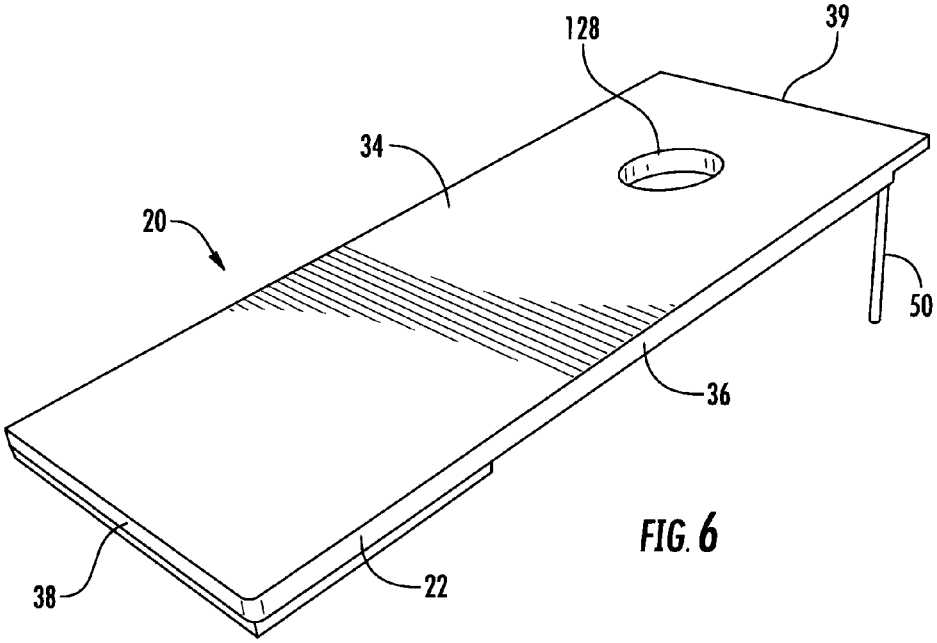
FIG. 6 is an isometric view of one board flipped over for a second game.

In another embodiment of the present invention, referring now to FIG. 6, the board 22 is shown in a flipped over position, which may be designed to play a different game than the golf chipping game, such as cornhole, bag toss, bags, or any other game utilizing a flat surface at a slight angle with a hole near the far end of the board. To utilize this position, the goal 40 has been removed except the lower posts 50. The lower posts may be dimensioned such that the end 39 of the board stands about 12 inches off the ground to mimic a regulation cornhole board. If the sleeve 52 is fixedly attached to the lower posts 50, the sleeves may aid in securing the board at its proper height when resting on different ground materials, such as soft grass or beach sand.

A detailed description of how the board 20 may be converted from a golf chipping game to a game involving bean bags or the like is as follows. The upper posts 48 is slidably removed from the lower posts 50 using any of the aforementioned methods. The crossbar 44 and the mesh net 46, which may be fixedly attached to the upper posts 48, are removed from the board 20 along with the upper posts 48. The board 20 is then flipped over, such that the first surface 32 is no longer facing upward, and the second surface 34 now faces substantially upward. The board 20 is then placed on the ground or other playing surface, and is propped up at one end by the lower posts 50. In another embodiment, the lower posts 48 are removed along with the rest of the goal 40, and the second surface 34 is another game similar to cornhole that does not require the board to be propped up at an end 39.

Figure 7:
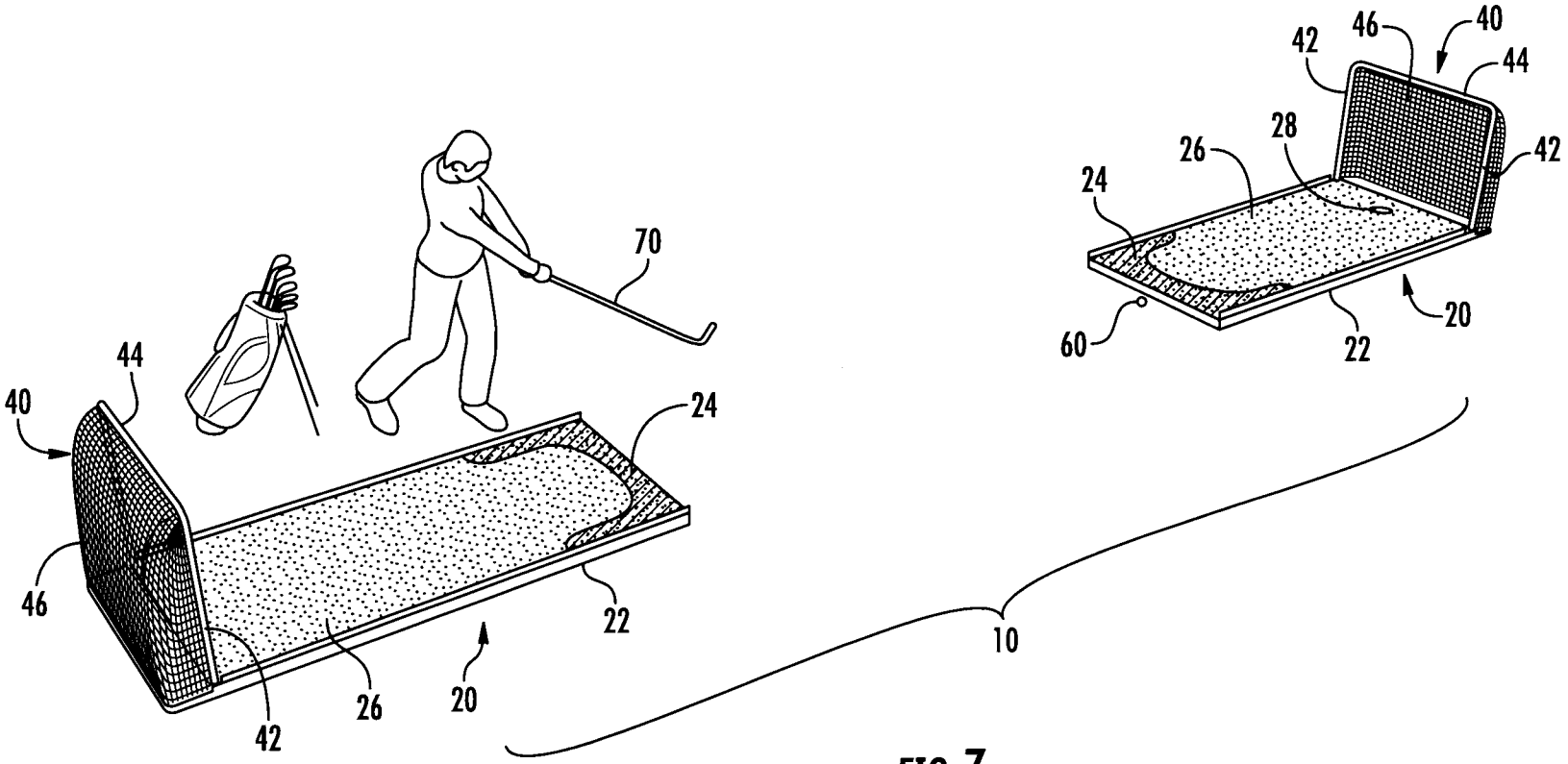
FIG. 7 is an isometric view of another embodiment of the golf chipping game.
Figure 8:
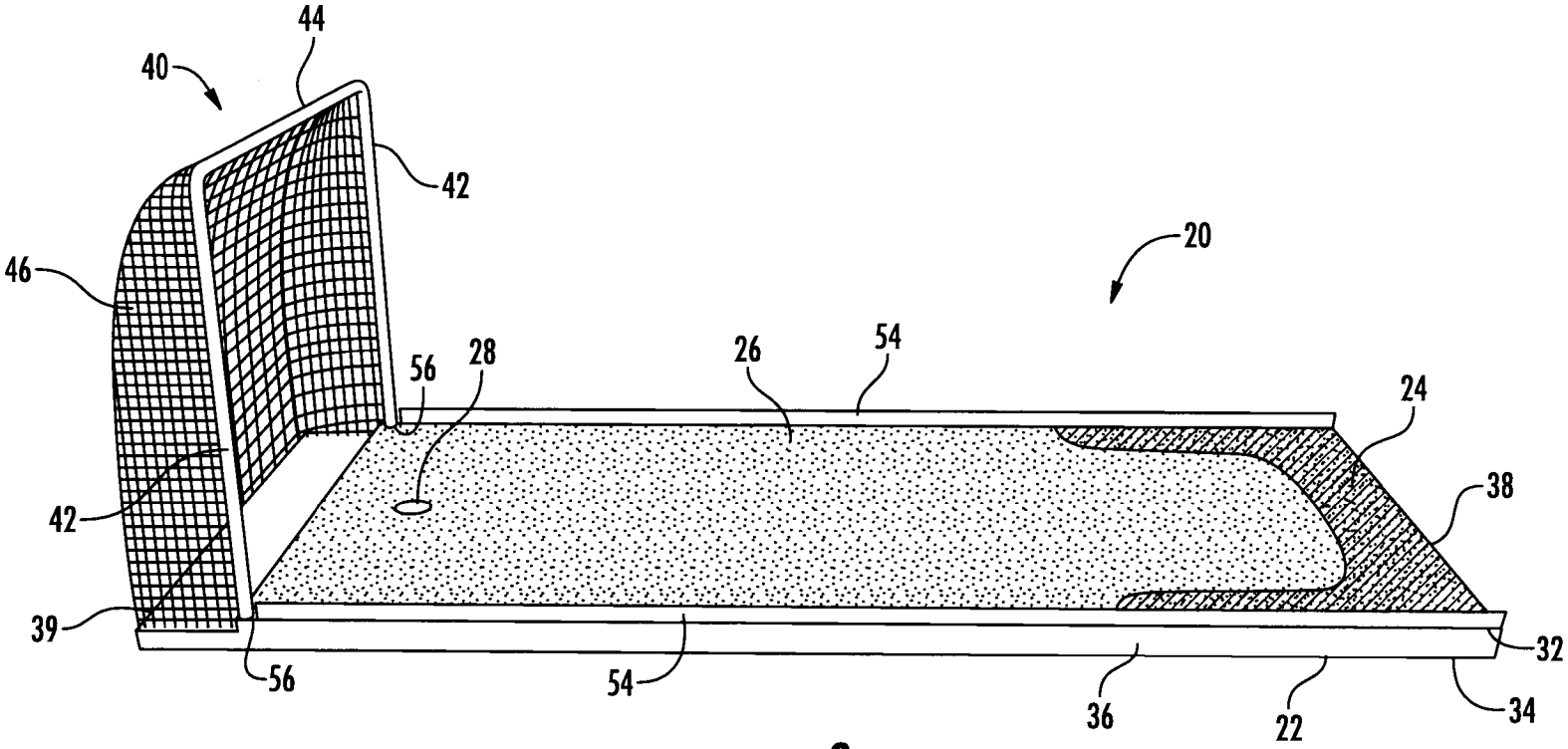
FIG. 8 is a side elevation view of one board of another embodiment of the golf chipping game.
Figure 9:
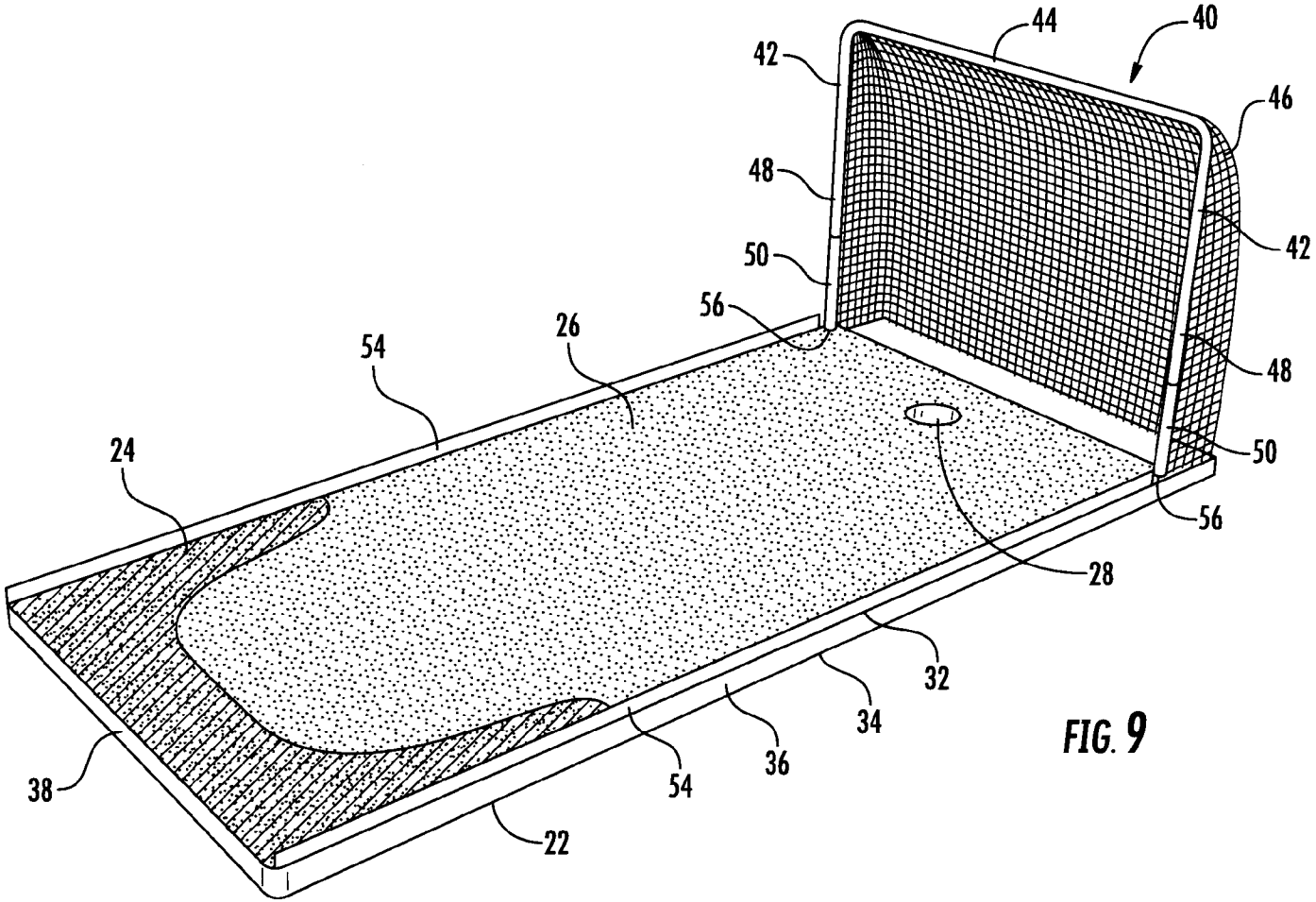
FIG. 9 is a closer isometric view of a goal of another embodiment of the golf chipping game.
Figure 10:
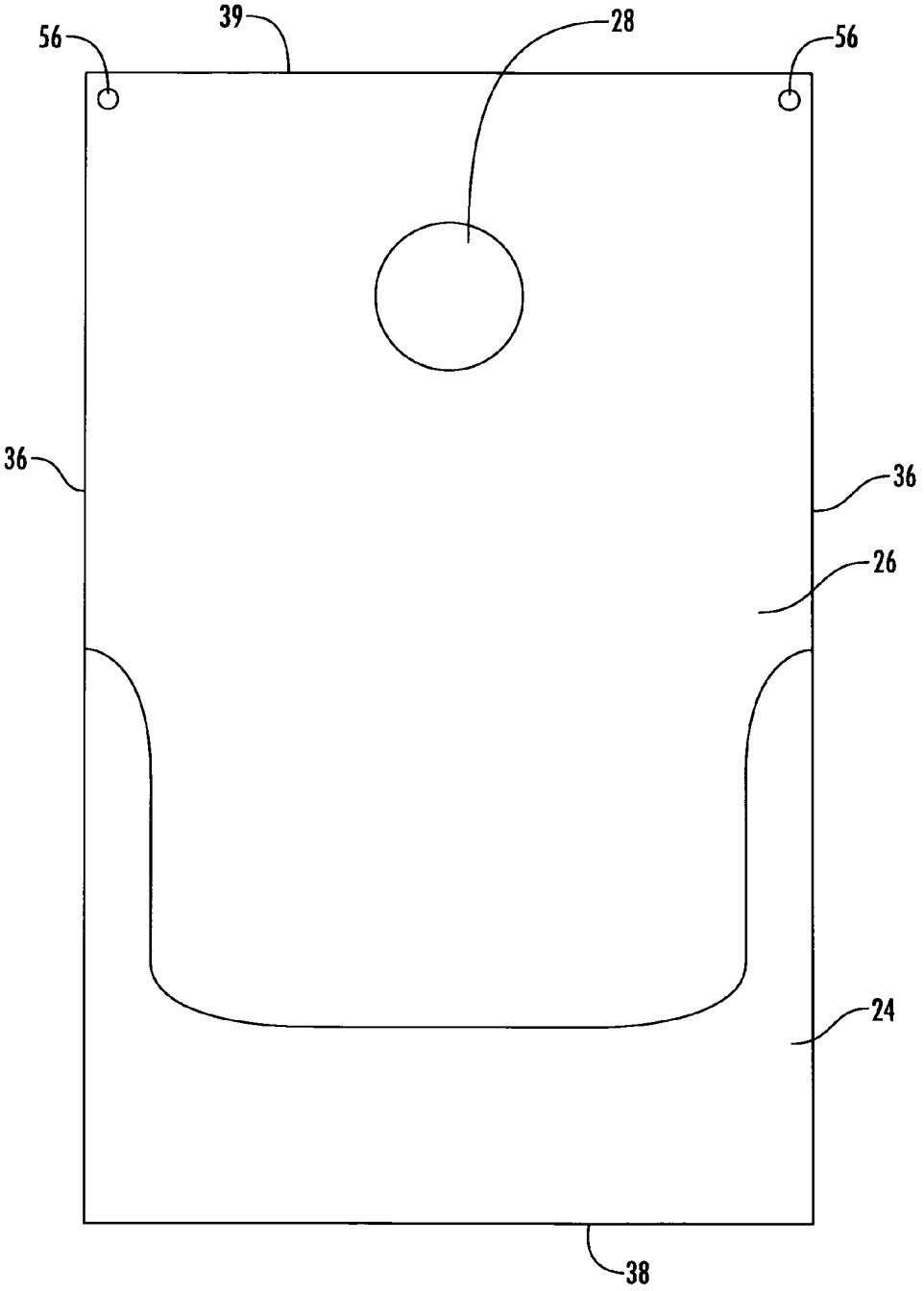
FIG. 10 is an isometric view of one board of another embodiment of the golf chipping game.

In another embodiment as detailed in FIGS. 7-10, the playing board 20 may also have a lip or edge 54, which prevents the ball from rolling off of board and assists the player in capturing the ball. The playing board 20 may also have holes 56 on either side of end 39 in which side posts 42 for net 46 may be attached. FIGS. 7-10 also detail a different shape scoring area 26 and chipping region 24. FIG. 7 shows a similar setup as in FIG. 1, but instead of a square chipping region, the chipping region 24 has a shape that corresponds to a greater scoring opportunity the closer to the middle of the board a user hits the ball. FIG. 8 shows a raised wall 54 to help the user keep the ball 60 on the playing board 20 is the user hits it on the board. FIG. 9 discloses a closer look at the shape of the chipping area 24. As will be understood by one skilled in the art, any combination of assembly and scoring areas as previously discussed can be introduced and is within the disclosure.

Figure 11:
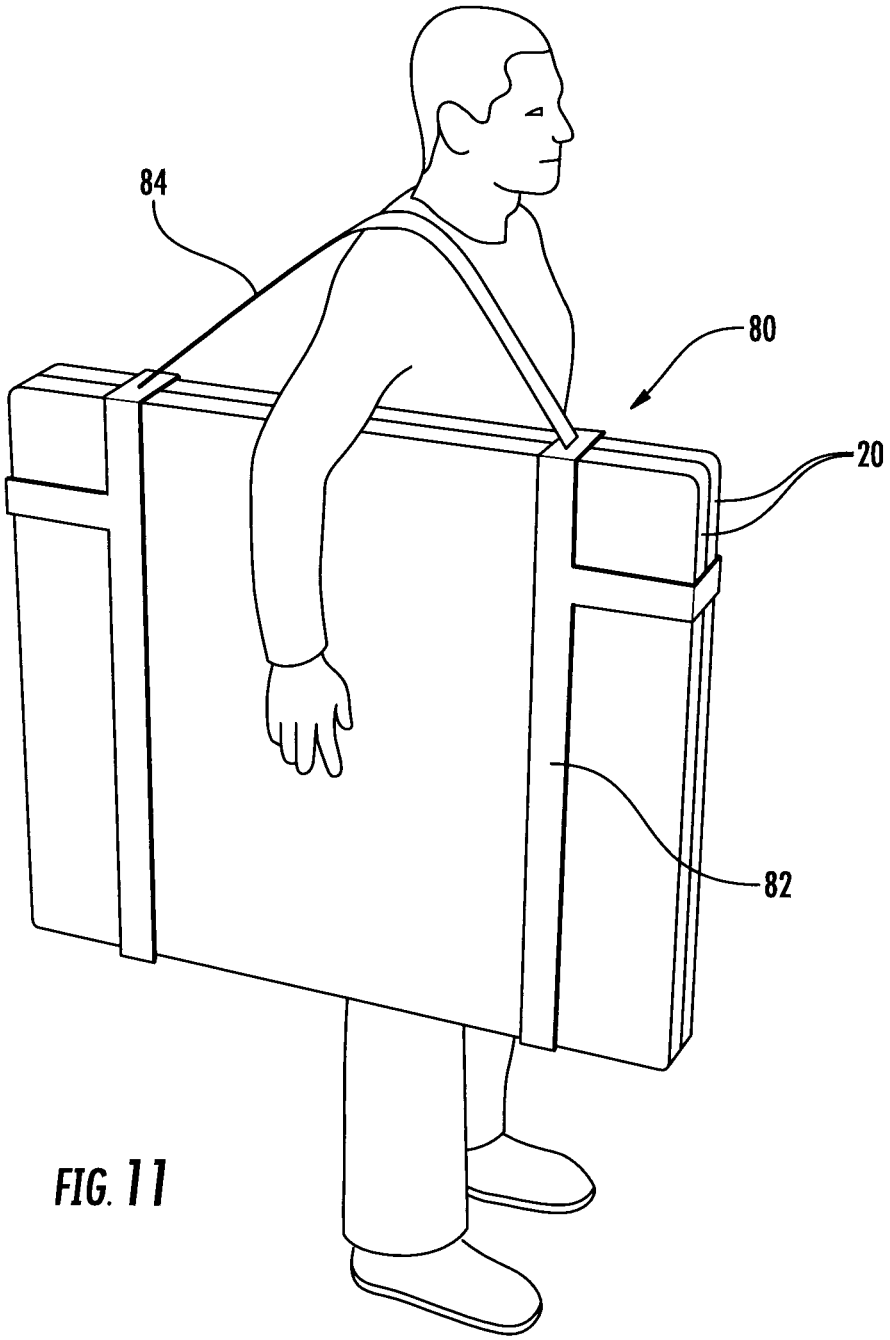
FIG. 11 is a view of a carrying assembly of the game boards.

FIG. 11 details the portability of the board 20. A handle assembly 80 may have a board strap 82 which wraps around a board 20 to ease the carrying of the board. The handle assembly may also have a handle strap 84 which may fit over a user's shoulder for easily carrying the board 20 without the aid of another person or other tool to assist. The board 20 may be of a weight that is able to be carried by a single user, between about 5 pounds and about 20 pounds, preferably about 10 pounds. As shown in FIG. 7, a pair of board straps 82 fit snugly around two boards 20 holding them together, and connecting through the handle strap 84. In another embodiment, the board straps may fit around a single board 20. In still another embodiment, a single board strap 82 may wrap around one or more boards 20 and have a handle strap 84 for easily carrying the board or boards 20. Depending on the material chosen for the board(s), wheels may be attached or a cart may be provided for portability of the boards to and from the chosen playing area.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A portable playing system for a golf chipping game comprising:

a playing board comprising:

a first surface substantially rectangular in shape having a length longer than a width, the first surface comprising a shooting region comprising a synthetic grass with a length from about ¾ inches to about 2 inches, and a scoring region comprising a synthetic grass with a length from about ¼ inches to about 1¾ inches, the first surface length being from about 36 inches to about 54 inches long, and the width being from about 18 inches to about 36 inches wide;

a second surface disposed parallel to the first surface and having substantially the same dimensions;

wherein the first and second surfaces further each comprise an aperture substantially circular in shape and with a center located within about 6 to about 12 inches of one end of the first and second surfaces;

four side walls interconnecting the first and second surfaces and about 1½ inches to 2 inches in width; and a goal disposed substantially on one end of the first surface, the goal comprising:

at least two substantially vertical side posts and a substantially horizontal crossbar connected to the top of the side posts; and a mesh net connected to the side posts and crossbar and substantially extends within the entire area between the side posts and from the crossbar to the first surface, and configured to trap a ball within the goal;

wherein the goal spans the width of the first surface;

wherein the portable playing system comprises a first playing position whereby the first surface faces substantially upward, and a second playing position whereby the second surface faces substantially upward and is propped up at one end by at least a portion of the vertical side posts; and wherein the board is manually portable by a user.

2. The portable playing system of claim 1, wherein the shooting region spans substantially the width of the first surface and is located from an end of the first surface opposite the aperture to about 8 to about 24 inches from the end of the first surface opposite the aperture.

3. The portable playing system of claim 2, wherein the scoring "green" region is comprises the entirety of the first surface not covered by the shooting region.

4. The portable playing system of claim 1, wherein each of the at least two side posts are removable.

5. The portable playing system of claim 1, wherein each of the at least two side posts comprise a main body portion and a removable upper portion.

6. The portable playing system of claim 5, wherein the main body portion is coupled to the removable upper portion by a sleeve.

7. The portable playing system of claim 5, wherein the upper removable portion has an insert with an outside diameter smaller than the inside diameter of the main body portion, the insert being configured to insert into the main body portion.

8. The portable playing system of claim 5, wherein when the portable playing system is in the second playing position, the upper removable portions, the crossbar, and the net are removed from the portable playing system.

9. The portable playing system of claim 6, wherein the portable playing system is propped up at one end by the main body portions of the side posts.

10. The portable playing system of claim 1, wherein the aperture in the first surface and the aperture in the second surface are substantially the same size and in the substantially the same position on the portable playing system, and the diameter of which is from about 5½ inches to about 6½ inches.

11. The portable playing system of claim 10, wherein the aperture in the first surface and the aperture in the second surface are interconnected by a cylinder with an axis substantially normal to the first surface and the second surface.

12. The portable playing system of claim 1, wherein the first surface, second surface, and four side walls comprise a single monolithic material.

13. The portable playing system of claim 1, wherein the playing board is a first playing board, and further comprising a second playing board.

14. The portable playing system of claim 13, wherein the first and second playing boards are convertible between a golf chipping game when the first surface is facing up, and a bean bag toss game when the second surface is facing up.

15. The portable playing system of claim 1, further comprising at least one board strap and a board handle couple to the at least one board strap, wherein the at least one board strap is configured to hold a playing board, and the board handle is configured for easy transport by a game player.

16. The portable playing system of claim 15, further comprising a first and second board strap, wherein the first and second board straps are configured to hold two playing boards.

17. A portable playing system which can be converted from a golf chipping game to another game, comprising:

a first surface rectangular in shape and having a length longer than a width, and having a hole located in the middle of the width and closer to a first end than a second end;

wherein the first surface has a chipping portion and a scoring portion, the chipping portion having a synthetic grass from about ¾ inches to about 1¼ inches long, and the scoring portion having a synthetic grass from about ¼ inches to about ¾ inches long;

a second surface parallel with the first surface and substantially the same dimensions as the first surface, wherein the hole in the first surface extends through the second surface; and a goal assembly configured to span substantially the entire width of the first surface, comprising at least two substantially vertical side post assemblies anchored in the first surface and a substantially horizontal crossbar coupled to the top of the side post assemblies, and a mesh net connected to the side posts and crossbar and spanning substantially the entire area between the side post assemblies and from the crossbar to the first surface;

wherein the two side post assemblies each comprise an upper post and a lower post; and wherein the first surface is facing in a substantially upward direction;

wherein each of the two side post assemblies may be disassembled by detaching the upper post from the lower post, removing the two upper posts, crossbar and mesh net from the first surface, leaving the two lower posts anchored in the first surface; wherein the system may be flipped such that the first surface is facing substantially downward, the second surface is facing upward and the system is supported by the two lower posts and second end of the board.

18. The portable playing system of claim 17, wherein the first surface comprises a golf chipping game, and the second surface comprises a bean bag toss game.

19. A portable playing system containing a board with two surfaces which can be converted from a golf chipping game to a bean bag toss game comprising:

a board with two surfaces which can be converted from a golf chipping game to a bean bag toss game, comprising:

a first surface rectangular in shape and having a length longer than a width, and having a hole located in the middle of the width and closer to a first end than a second end;

wherein the first surface has a chipping portion and a scoring portion, the chipping portion having a synthetic grass from about ¾ inches to about 1¼ inches long, and the scoring portion having a synthetic grass from about ¼ inches to about ¾ inches long;

a second surface parallel with the first surface and substantially the same dimensions as the first surface, wherein the hole in the first surface extends through the board and the second surface; and a goal assembly configured to span substantially the entire width of the first surface, comprising at least two substantially vertical side post assemblies anchored in the board and a substantially horizontal crossbar coupled to the top of the side post assemblies, and a mesh net connected to the side posts and crossbar and spanning substantially the entire area between the side post assemblies and from the crossbar to the first surface;

wherein the two side post assemblies each comprise an upper post and a lower post;

wherein the first surface is facing in a substantially upward direction during the golf chipping game;

wherein, when net assembly and upper portions of posts are removed and board is flipped, the second surface is facing in a substantially upward direction during the bean bag toss game; and the second surface is tilted at an angle when the board is supported by the two lower posts and second end of the board.

* * * * *